US005460485A

United States Patent [19]

Sugiyama et al.

[11] Patent Number: 5,460,485

[45] Date of Patent: Oct. 24, 1995

[54] BLOWER WITH AN IMPROVED SHROUD ASSEMBLY

[75] Inventors: Toshiki Sugiyama; Yoshitake Hoshino, both of Kariya, Japan

[73] Assignee: Nippondenso Co., Ltd., Kariya, Japan

[21] Appl. No.: 218,940

[22] Filed: Mar. 28, 1994

[30] Foreign Application Priority Data

Mar. 29, 1993 [JP] Japan ..... 5-070588
Jan. 21, 1994 [JP] Japan ..... 6-005405

[51] Int. Cl.[6] ..... F04D 29/54

[52] U.S. Cl. ..... 415/208.2; 415/119; 416/169 A; 416/244 R; 416/247 R; 123/41.49; 264/318; 425/577; 425/DIG. 58

[58] Field of Search ..... 415/121.2, 208.1, 415/208.2, 211.2, 119; 416/169 A, 244 R, 247 R; 123/41.11, 41.98, 41.49; 264/318; 425/438, 577, DIG. 58; 249/60

[56] References Cited

U.S. PATENT DOCUMENTS

| | | | |
|---|---|---|---|
| 5,102,607 | 4/1992 | Hickman et al. | 425/577 |
| 5,131,352 | 7/1992 | Hoshino et al. | 416/247 R |
| 5,232,718 | 8/1993 | Miyazawa et al. | 425/577 |
| 5,304,040 | 4/1994 | Wang | 416/247 R |

FOREIGN PATENT DOCUMENTS 56-032100 4/1981 Japan .
4-112918 4/1992 Japan .

OTHER PUBLICATIONS

Japanese Publication "Automobile Engineering", vol. 43, No. 12, Dec. 1989 pp. 98–103.

*Primary Examiner*—Edward K. Look
*Assistant Examiner*—Christopher Verdier
*Attorney, Agent, or Firm*—Cushman, Darby & Cushman

[57] ABSTRACT

A blower having an axial fan driven by a rotating drive source and enclosed by a shroud assembly including a substantially cylindrical fan shroud enclosing an outer circumference of the axial fan, and a protective unit provided with a plurality of support beams extending from the fan shroud toward an air intake side of the blower and cooperating with a plurality of ring-like members so as to form a protective net member for preventing entrance of any unfavorable substances such as foreign matter or a human finger into the shroud assembly, and a plurality of support ribs operating as a physical rib members and as protective members preventing entrance of the unfavorable substances from a radially outer region of the blower into the interior of the shroud assembly. The support ribs are arranged so as to provide a large spacing between the ribs and the outer circumference of the axial fan to thereby reduce generation of turbulence of the intake air resulting in a lowering of the hissing or whistling sound of the air flowing across the support ribs and through the axial fan.

12 Claims, 8 Drawing Sheets

BLOWER WITH AN IMPROVED SHROUD ASSEMBLY

BACKGROUND OF THE INVENTION

1. Field of the Invention

The present invention relates to a blower having an axial fan driven by a drive source arranged upstream the fan, and an integrally molded assembly to support the drive source, a shroud enclosing the axial fan, and a protective net adapted for preventing either a person from inserting his fingers into the blower or foreign materials from entering the blower from the upstream side of the axial fan. More particularly, the present invention relates to an air blower adapted for use in supplying heat exchanging devices of an automobile, such as a radiator or a refrigerant condenser for the automobile climate control system, with a flow of air. The present invention may be equivalently applicable to a fan having a lower gas discharging power.

2. Description of the Related Art

A typical conventional blower is shown in FIGS. 7 and 8. The conventional blower is provided with an axial fan 100, a protective net 101 arranged either for preventing a person's finger or fingers from entering the axial fan during the rotation thereof or for preventing foreign material from entering the blower, and a shroud 102 for enclosing the axial fan. The protective net 101 and the shroud 102 are both made of resin material, and are formed as an integrally molded assembly in order to reduce the manufacturing and assembling cost of the molded assembly.

When the axial fan 100 of the blower is driven, an air flow is generated so as to enter the blower not only through an air intake port in the axial direction but also through a region circumferentially extending around the air intake port. All of the air entering the blower is discharged as blown air through an air outlet of the blower.

In order to permit the air to easily enter the blower, the protective net 101, which is located at upstream the axial fan 100 and is formed integrally with the shroud 102, is arranged so as to be axially spaced apart from the shroud 102. Thus, the protective net 101 is supported by a number of support ribs 103 extending from the end of the shroud 102 toward the air intake port of the blower. Thus, a number of openings are defined by the support ribs 103 between the protective net 101 and the shroud 102 in such a manner that the openings are circumferentially juxtaposed. Accordingly, air can flow into the blower through the openings of the support ribs 103 so as to be mixed with the air flowing into the blower through the above-mentioned air intake port. Namely, the arrangement of the support ribs 105 is contrived so as to permit the air to pass through the openings of the support ribs 103 to thereby be smoothly mixed with the air entering through the air intake port of the blower.

The protective net 101 is constructed so that the blowing performance of the blower is not reduced due to an existence of the net 101 and so that the manufacturing cost of the protective net 101 can be lower. Thus, the protective net 101 is provided with a plurality of stays 105 having the above-mentioned support ribs 103 arranged so as to provide an interconnection between a support bracket 104 and the above-mentioned shroud 102, and a plurality of annular ribs 106 extending annularly around the air intake port so as to mutually connecting the respective stays 105.

The support bracket 104 arranged adjacent the air intake port supports a drive source driving the axial fan on the side of the air intake port.

With the above-mentioned construction of the conventional blower, the support ribs 103 are manufactured by a molding method in which they are integrally molded with the shroud 102 and the protective net 101. Therefore, in order to allow a molded assembly of the protective net 101, the shroud 102, and the support ribs 103, i.e., a molded shroud assembly to be readily removed from the molding dies during the molding process, an inner circumference of the support ribs 103 must be designed so as to have a diameter equal to that of the shroud 102. Consequently, a spacing between the edge of the axial fan 100 and the inner circumference of the support ribs 103, designated by "B" in FIG. 7 must be very small and results in an increase in noise generated by the air flow passing through the small space "B".

More specifically, since respective openings of the support ribs 103 must be small from the viewpoint of the afore-mentioned protecting purpose, a number of support ribs 103 are provided in a juxtaposed arrangement in the circumferential direction around the air intake of the blower, and accordingly, the provision of many support ribs 103 makes the sound louder when the air flows across the support ribs 103, Thus, the conventional blower has such defect in that the noise generating during the operation of the blower is loud.

SUMMARY OF THE INVENTION

Therefore, an object of the present invention is to provide a blower adapted for use in, not exclusively but preferably, blowing air toward a heat exchanging devices such as an automobile radiator or a condenser of an automobile climate control system, and capable of eliminating the defect in the conventional blower.

Another object of the present invention is to provide a blower provided with an axial fan, and a molded shroud assembly having a fan shroud arranged so as to enclose the axial fan, a support bracket for supporting a drive source to drive the axial fan at an air intake side of the fan shroud, a plurality of stays having support ribs which are arranged so as to extend from the fan shroud toward an air intake port of the blower and so as to provide a physical connection between the fan shroud and the support bracket, and a plurality of annularly extending rings arranged so as to provide a physical connection between the respective stays, the fan shroud, the support bracket, the stays, and the rings of the shroud assembly being integrally molded in such a manner that the shroud assembly is able to prevent entrance of any unfavorable substance including human fingers and foreign materials into the blower and to suppress the noise generated by air passing across the shroud assembly.

A further object of the present invention is to provide a blower provided with a resin-molded shroud assembly having a fan shroud, a support bracket for supporting a fan drive source, a protective net, a plurality of stays, and a plurality of annularly extending rings which are integrally molded by the use of molding dies at a manufacturing cost comparable with the conventional blower.

In accordance with the present invention, there is provided a blower which is provided with:

an axial fan arranged so as to be driven by a rotating drive source, and provided with a plurality of rotating blades generating a flow of air during rotation thereof about an axis of the axial fan;

a fan shroud in the form of a substantially cylindrical hollow member enclosing the outer circumference of the axial fan and having an end facing an air intake side of the blower and an opposite end facing an air discharge side of the blower, the fan shroud being provided with a bell-mouth portion thereof flaring toward the air intake side;

a plurality of pin-like support ribs formed so as to be integral with the fan shroud, and arranged so as to project from an outermost end of the bell-mouth portion of the fan shroud toward the air intake side, the plurality of support ribs being disposed along an entire outer circumference of the bell-mouth portion of the fan shroud in a juxtaposed arrangement, and so as to be parallel with the axis of the axial fan;

a support bracket arranged for supporting the rotating drive source of the axial fan at the air intake side of the blower, the support bracket being formed so as to be integral with the fan shroud;

a plurality of stays formed so as to be integral with the fan shroud and the support bracket, the plurality of stays being arranged at the air intake side of the blower, and providing a physical connection between the fan shroud and the support bracket, the plurality of stays including support beams extending substantially in parallel with the axis of the axial fan; and a plurality of ring-like members formed so as to be integral with the fan shroud, the support bracket, and the plurality of stays, the plurality of ring-like members being arranged at the air intake side of the blower, and providing the plurality of stays with a physical connection thereamong.

In accordance with the above-mentioned construction of the blower of the present invention, the pin-like ribs provided for preventing entrance of any unfavored substances, including human fingers and foreign material, into the blower are arranged as axial protrusions extending axially from the fan shroud end. Therefore, when the shroud assembly of the blower is manufactured by using molding dies integrally molding the fan shroud, the ribs, the stays, and the annularly extending rings, the above-mentioned pin like ribs may be readily molded by molding dies to be used for molding the bell-mouth portion of the fan shroud which flares axially toward an air intake side of the blower. Thus, the ribs can be arranged around the end of the bell-mouth portion of the fan shroud. Thus, a space "A" between the ribs and the end of the axial fan can be larger than in the case of the conventional blower. Therefore, it is possible to reduce the sound generated when air passes across the ribs and across the axial fan. Accordingly, even when the number of ribs is large, the whole sound level can be low resulting in successfully suppressing the noise of the blower.

Further, the shroud assembly can be easily manufactured by a molding method in which the fan shroud, the support bracket for the drive source of the axial fan, and the protective net including the ribs, the stays, and the rings are all together molded integrally. Thus, the manufacturing cost can be low.

The pin-like ribs may be molded so as to have either a cylindrical outer surface or a streamline outer surface to thereby suppress generation of turbulence of air at a position downstream the ribs. As a result, generation of noise which occurs when the air passes across the ribs and the axial fan can be effectively suppressed.

BRIEF DESCRIPTION OF THE DRAWINGS

The above and other objects, features, and advantages of the present invention will be made more apparent from the ensuing description of preferred embodiments with respect to the accompanying drawings wherein.

DESCRIPTION OF THE PREFERRED EMBODIMENTS

Figure 1:
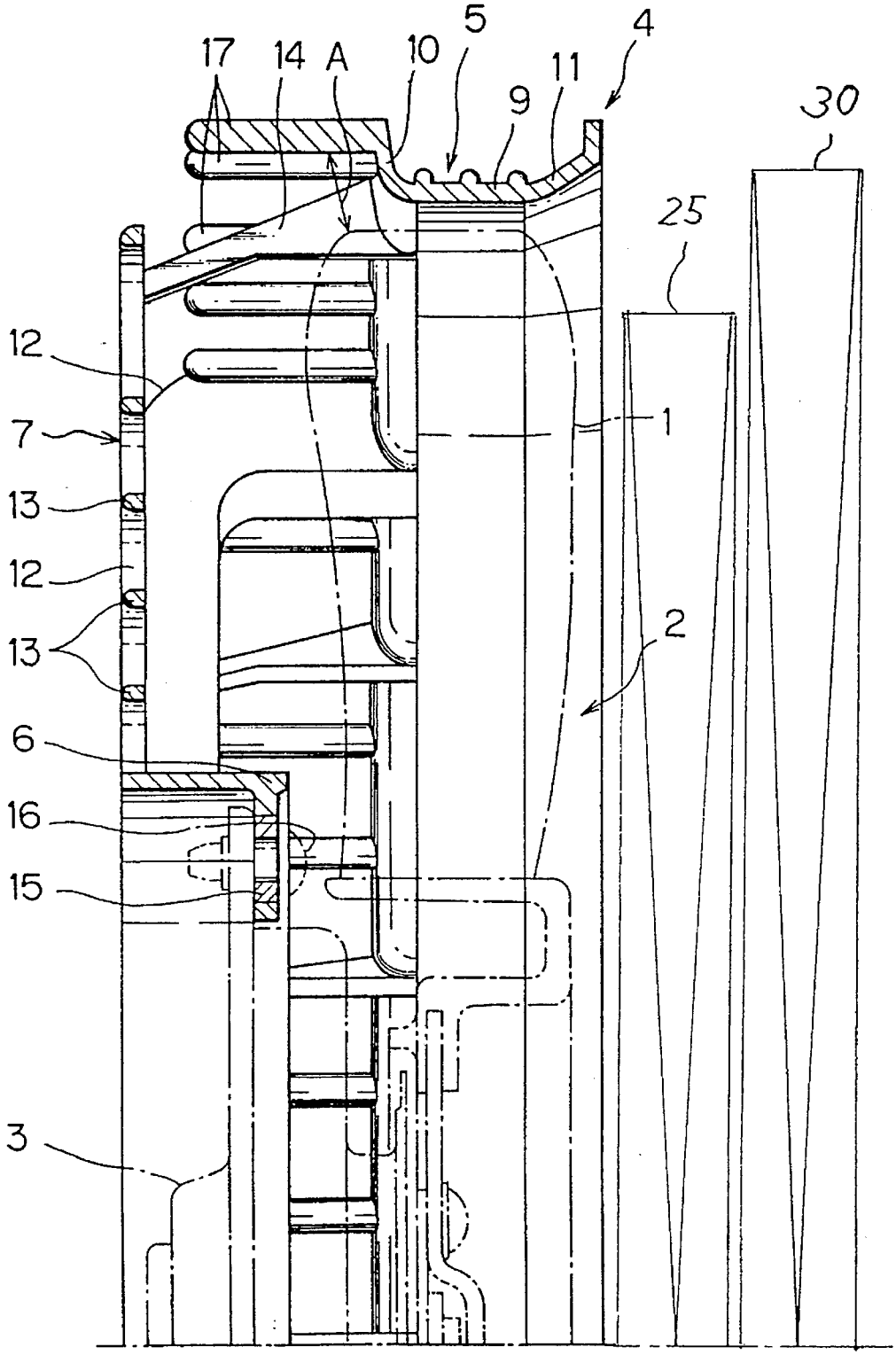
FIG. 1 is a cross-sectional view of a half portion of a blower according to an embodiment of the present invention, taken along line I of FIG. 3.
Figure 2:
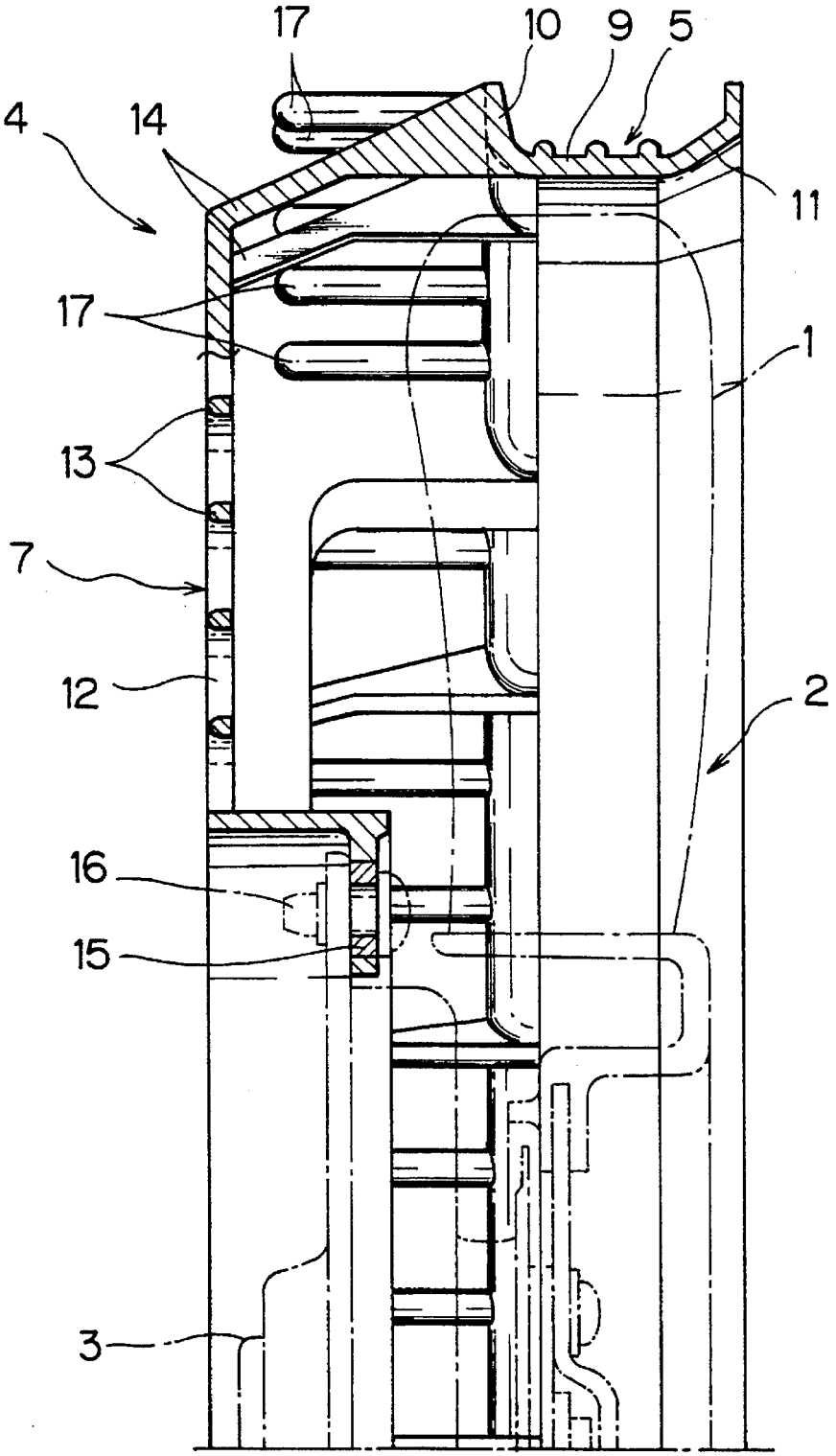
FIG. 2 is a different cross-sectional view of a half portion of a blower according to an embodiment of the present invention, taken along line II of FIG. 3.
Figure 3:
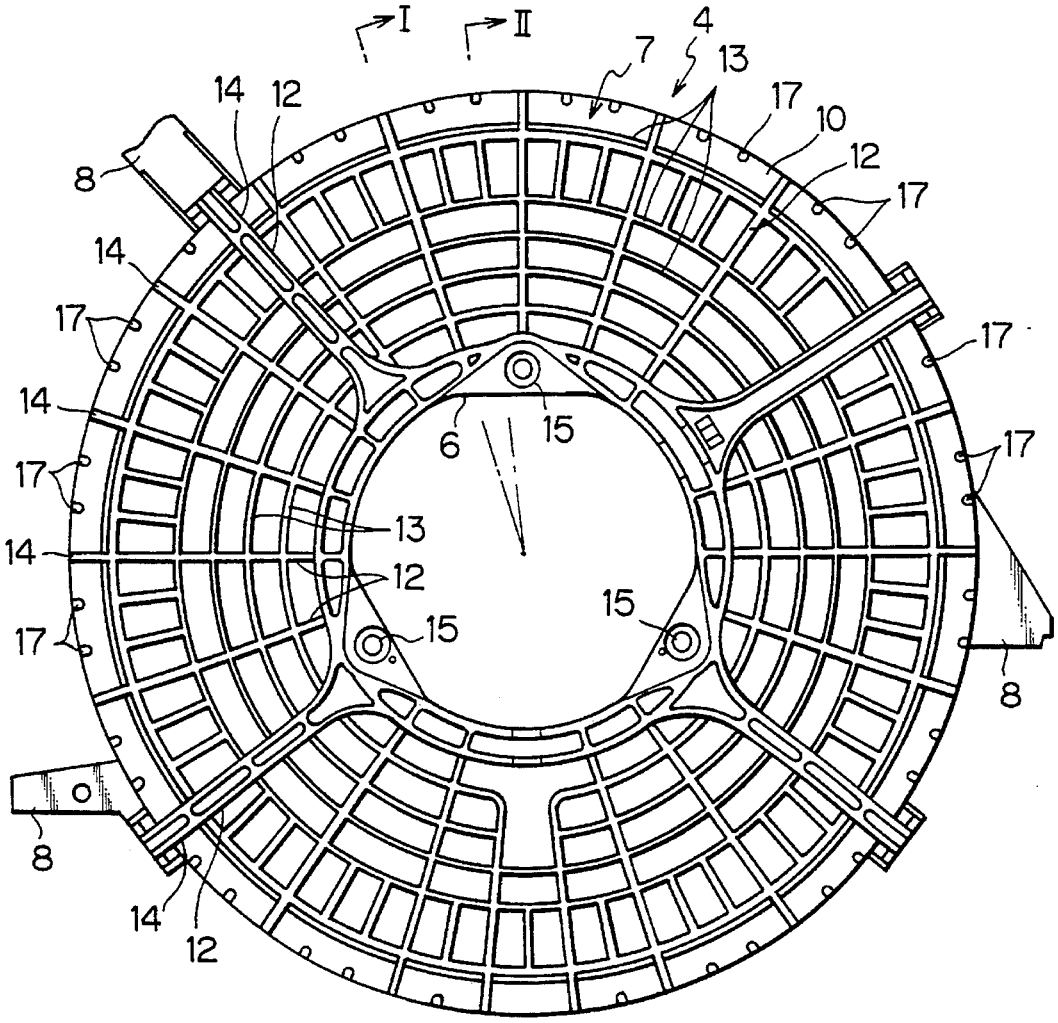
FIG. 3 is a front view of the blower according to an embodiment of the present invention, illustrating the entire front view of the shroud assembly of the blower.

Referring to FIGS. 1 through 3, the blower is constructed as a forced draft fan forcibly supplying air to a refrigerant condenser (not shown) of an automobile air-conditioning or climate control system and an automobile radiator (not shown) in a direction reverse to a direction in which an automobile runs. Therefore, the blower is provided with an axial fan 2 having a plurality of vanes 1 which, when being rotated, generates a flow of air, an electric drive motor 3 which is a drive source for driving the rotating motion of the vanes 1 and a shroud assembly 4 made of resin material.

The shroud assembly 4 is provided with a fan shroud 5, an annular support bracket 6 on which the electric drive motor 3 is mounted, a protective net 7 arranged on the air intake side of the fan shroud 5, and a plurality of stays 8 used for mounting the blower onto an automobile chassis, and all of the above-mentioned elements of the shroud assembly 4 are made of a resin material e.g., polypropylene resin, and are integrally molded by using molding dies. The fan shroud 5 is formed in a substantially cylindrical member arranged so as to enclose the axial fan 2. The support bracket 6 is arranged at a center of the shroud assembly at a position upstream the axial fan 2. The protective net 7 is arranged so as to extend around the support bracket 6, and functions so as to either prohibit a human finger or fingers from being intentionally or unintentionally inserted inside the shroud assembly 4 or prevent foreign material from entering the shroud assembly 4.

The fan shroud 5 includes a cylindrical portion 9 arranged adjacent to and outside a path along which the axial fan 2 rotates, a bell-mouth portion 10 arranged at an end of the cylindrical portion 9 on the side from which an intake air flows into the shroud assembly 5, and a skirt portion 11 arranged at the opposite end of the cylindrical portion 9 flaring downstream an air outlet of the blower from which the air is forcibly discharged.

The bell-mouth portion 10 is formed so as to be flared from the end of the cylindrical portion 9 toward the side on which the air intake port of the blower is arranged, and accordingly, the bell-mouth portion 10 enables the air to be smoothly drawn into the cylindrical portion 9.

The skirt portion 11 is formed so as to be flared from the opposite end of the cylindrical portion 9 toward the side on which the air outlet of the blower is arranged. Accordingly, the skirt portion 11 enables the air to be smoothly blown from the air outlet toward a destination such as the refrigerant condenser and the automobile radiator in the form of a smoothly flaring air flow.

The protective net 7 includes a plurality of radial stays 12 which are arranged so as to provide a physical interconnection between the fan shroud 5 and the support bracket 6, and a plurality of ring-like portions 13 by which the plurality of the stays 12 are physically interconnected with one another.

Each of the stays 12 is provided with a support beam 14 having one end connected to the fan shroud 5 and running in parallel with the axis of the axial fan 2. Thus, the shroud assembly 4 is provided with a plurality of the support beams 14 arranged around the axis of the axial fan 2. Thus, it is ensured that portions of the stays 12 except for the above-mentioned support beams 14, the ring-like portions 13, and the support bracket 6 are disposed at a position spaced apart a predetermined distance (e.g., 2 through 4 cm) from the end of the fan shroud 5, i.e., an open end thereof opening toward the air intake port of the blower. The ring-like portions 13 are radially spaced apart one another by a distance suitable for prohibiting entrance of any unfavorable substance such as human fingers or foreign material into the shroud assembly, and accordingly, the respective two neighboring ring-like portions 13 are radially spaced by an appropriate distance, e.g., approximately 1 cm.

Each of the respective stays 12 is mechanically reinforced by providing a portion thereof with a form having an approximate U section. The reinforced portion of the stay 12 can exhibit a high mechanical rigidity to stably hold the support bracket 6 on which the electric motor 3 is mounted. The motor 3 is fixed to the support bracket 6 by screws 16 threadedly engaged in threaded holes provided in the support bracket 6.

A plurality of support ribs 17 integrally connected, at respective bottom ends thereof, to the fan shroud 5 are provided so as to prevent unfavorable substances such as a human finger or foreign material and matter from being inserted into the shroud assembly 4 toward the axial fan 2. The support ribs 17 are disposed between respective two neighboring support beams 14, and the support ribs 17 are disposed at an approximately regular interval along the entire circumference of the outermost end of the bell-mouth portion 10 of the fan shroud 9.

Further, as best shown in FIGS. 1 and 2, the support ribs 17 project from the end of the fan shroud 5 toward the air intake side of the blower so as to be parallel with the axis of the axial fan 2. Each spacing provided between respective two neighboring support ribs 17 is determined so that any unfavorable substances such as a human finger or foreign material cannot be inserted through the space into the shroud assembly 4. Therefore, the spacings between the respective two neighboring support ribs 17 may be determined to be, for example, approximately 1 cm. Further, a spacing between the extreme end of each support rib 17 and the outermost ring-like portion 13 is similarly determined so as to be, for example, approximately 1 cm to thereby prohibit the entrance of unfavorable substances such as human fingers or foreign matter into the shroud assembly 4 through the above-mentioned spaces. It should be understood that in the illustrated preferred embodiment, the respective support ribs 17 are formed as a cylindrical rod having a spherical outer end thereof, respectively.

A description of the molding dies for use in molding the above-mentioned shroud assembly 4 will be provided hereinbelow with reference to FIGS. 4 through 6.

The molding die assembly for molding the shroud assembly 4 includes three molding dies, i.e., a first through third molding die 18 through 20.

The first molding die 18 is used for molding the inner wall of the fan shroud 5, the flaring region of the skirt portion 11 of the fan shroud 5, the air discharging side of the support bracket 6, and the air discharging side of the ring-like portions 13. The second molding die is used for molding the flaring region of the bell-mouth portion 10 of the fan shroud 5, the air intake side of the support bracket 6, the air intake side of the stays 12:, and the air intake side of a ring-like portions 13. The third molding die 20 is used for molding the outer circumference of the fan shroud 5.

When the molded shroud assembly 4 is taken out of the molding dies after completion of each molding process, the first molding die 18 is parted from the molding position toward the air discharging side of the shroud assembly 4, the second molding die 19 is parted toward the air intake side of the shroud assembly 4, and the third molding die 20 is parted toward the radially outward side of the shroud assembly 4.

Figure 4:
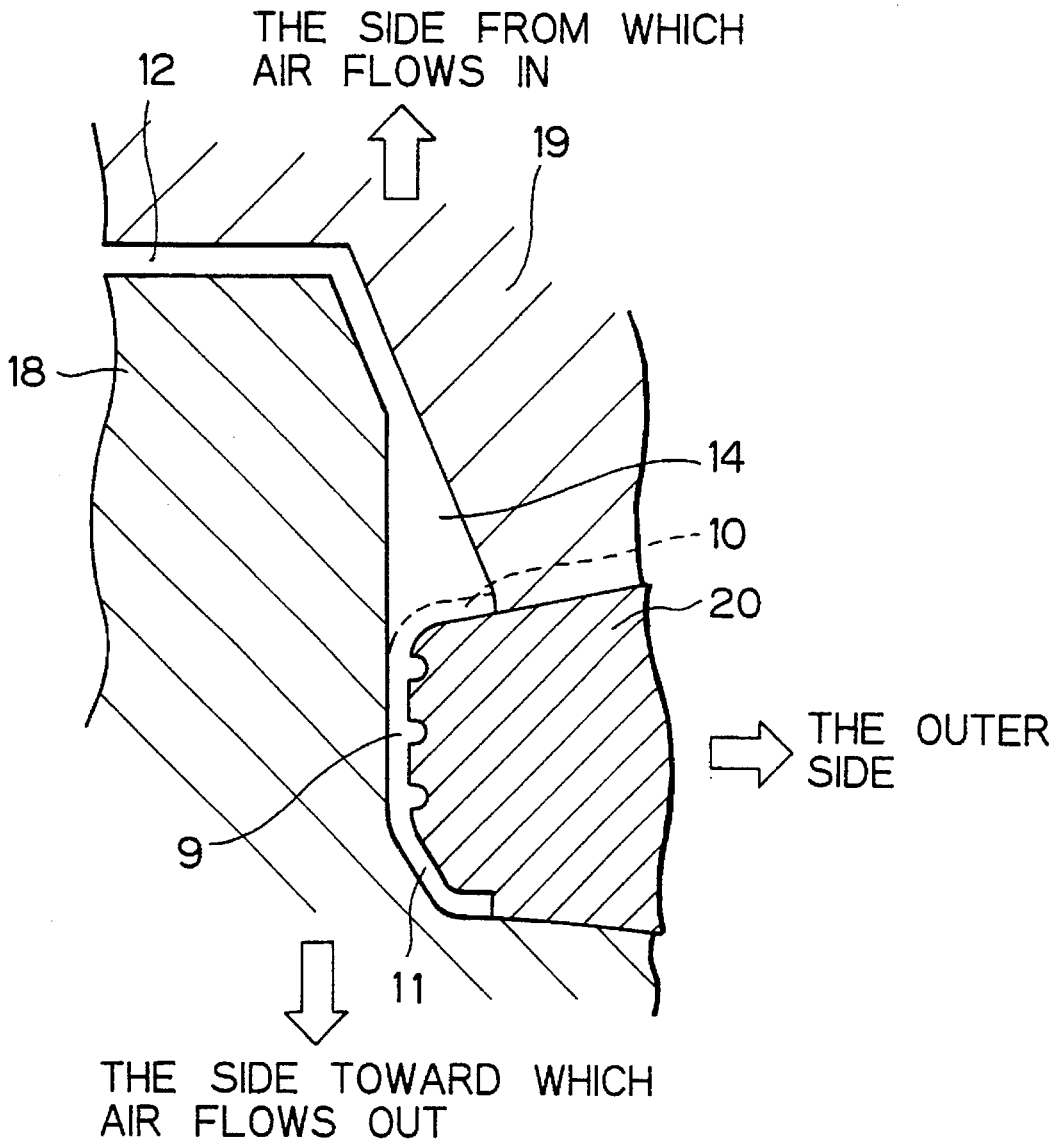
FIG. 4 is a partial cross-sectional view of molding dies, illustrating the molding process of supporting beams of the shroud assembly of the blower of FIG. 3.

More specifically, as shown in FIG. 4, the support beams 14 are molded by the first and second molding dies 18 and 19 which are parted toward the air discharge and intake sides, respectively, Accordingly, the diameter of the inner wall of each support beam 14 must be the same as that of the inner wall of the fan shroud 5. Thus, it is impossible to locate the inner wall of each support beam 14 at a position radially more distant than the bell-mouth portion 10 of the fan shroud 5 due to the construction of the first and second molding dies 18 and 19.

Figure 5:
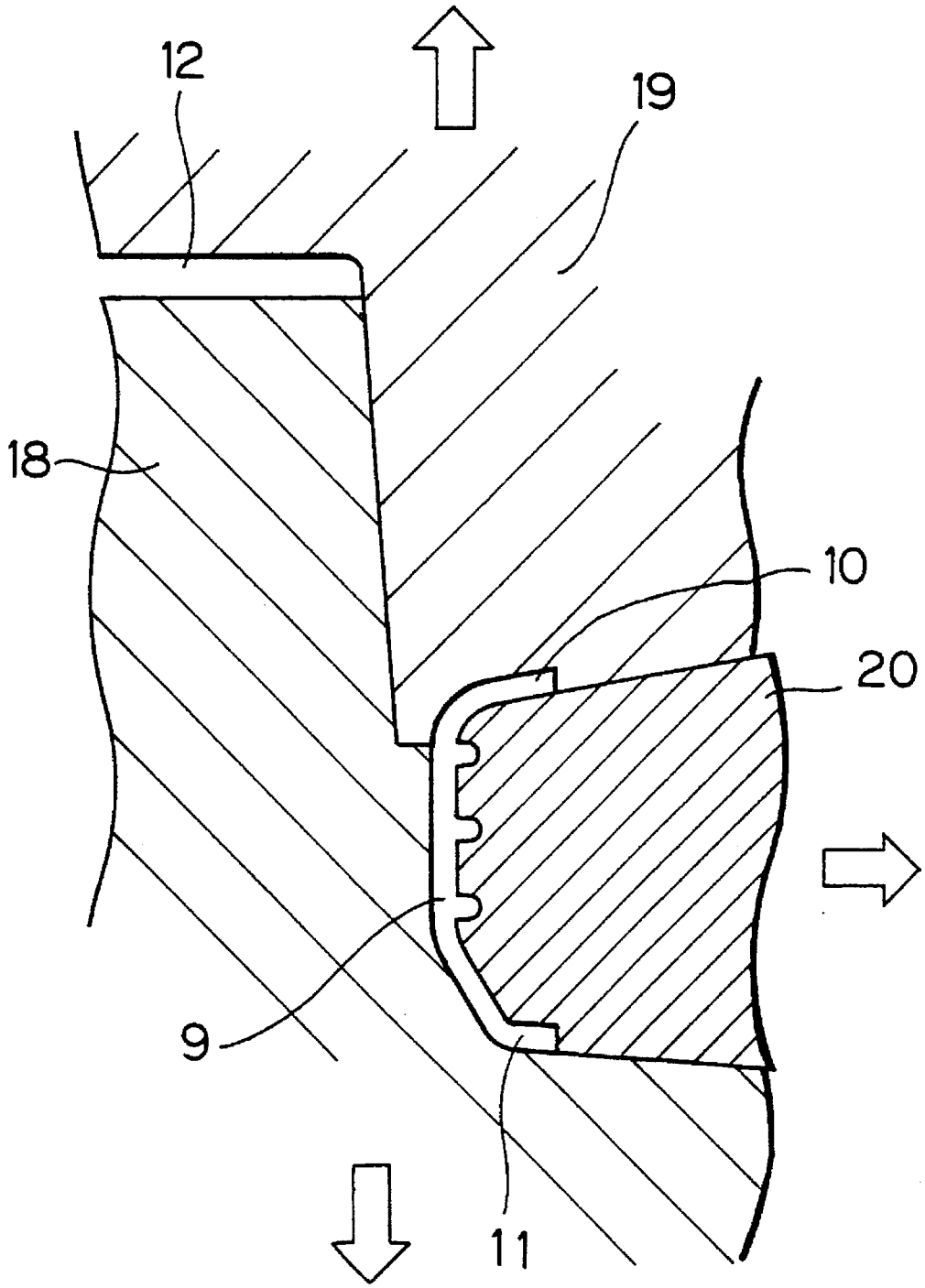
FIG. 5 is a partial cross-sectional view of the molding dies, illustrating the molding process of the bell-mouth portion of the fan shroud of the blower of FIG. 3.

At this stage, as shown in FIG. 5, the flaring portion of the bell-mouth portion 10 of the fan shroud 5 is molded by the second molding die 20 which is parted from the molding position thereof toward the air intake side of the shroud assembly 4.

Figure 6:
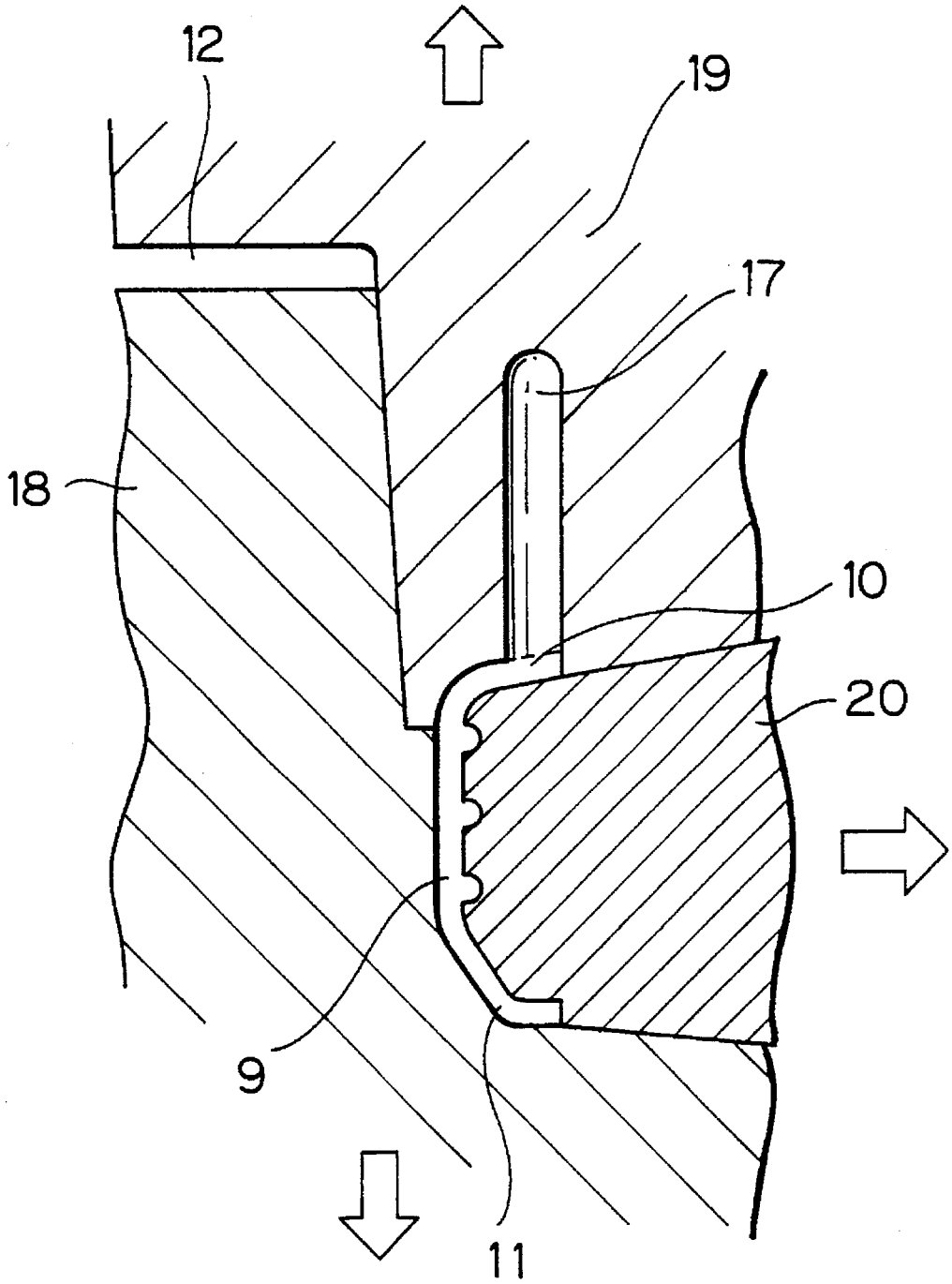
FIG. 6 is a partial cross-section view of the molding dies, illustrating the molding process of the pin-like ribs of the shroud assembly of the blower of FIG. 3.

As best shown in FIG. 6, the supporting ribs 17 extending from the radially outermost end of the bell-mouth portion 10 are molded by the above-mentioned second molding die 19 simultaneously with the flaring portion of the bell-mouth portion 10. At this stage, it should be understood that since each support rib 17 has a form of projection extending linearly, the second molding die 19 can be easily parted from the molding position toward the air intake side of the shroud assembly by pulling it along the support ribs 17. Accordingly, each support rib 17 may have one of various sections such as a circular section, an ellipsoidal section, and a streamline section. In addition, the support ribs 17 may be generally located at a radially more distant position of the support beams 14 with respect to the center of the shroud assembly 4.

The operation of the blower according to the described embodiment will be provided below.

Figure 7:
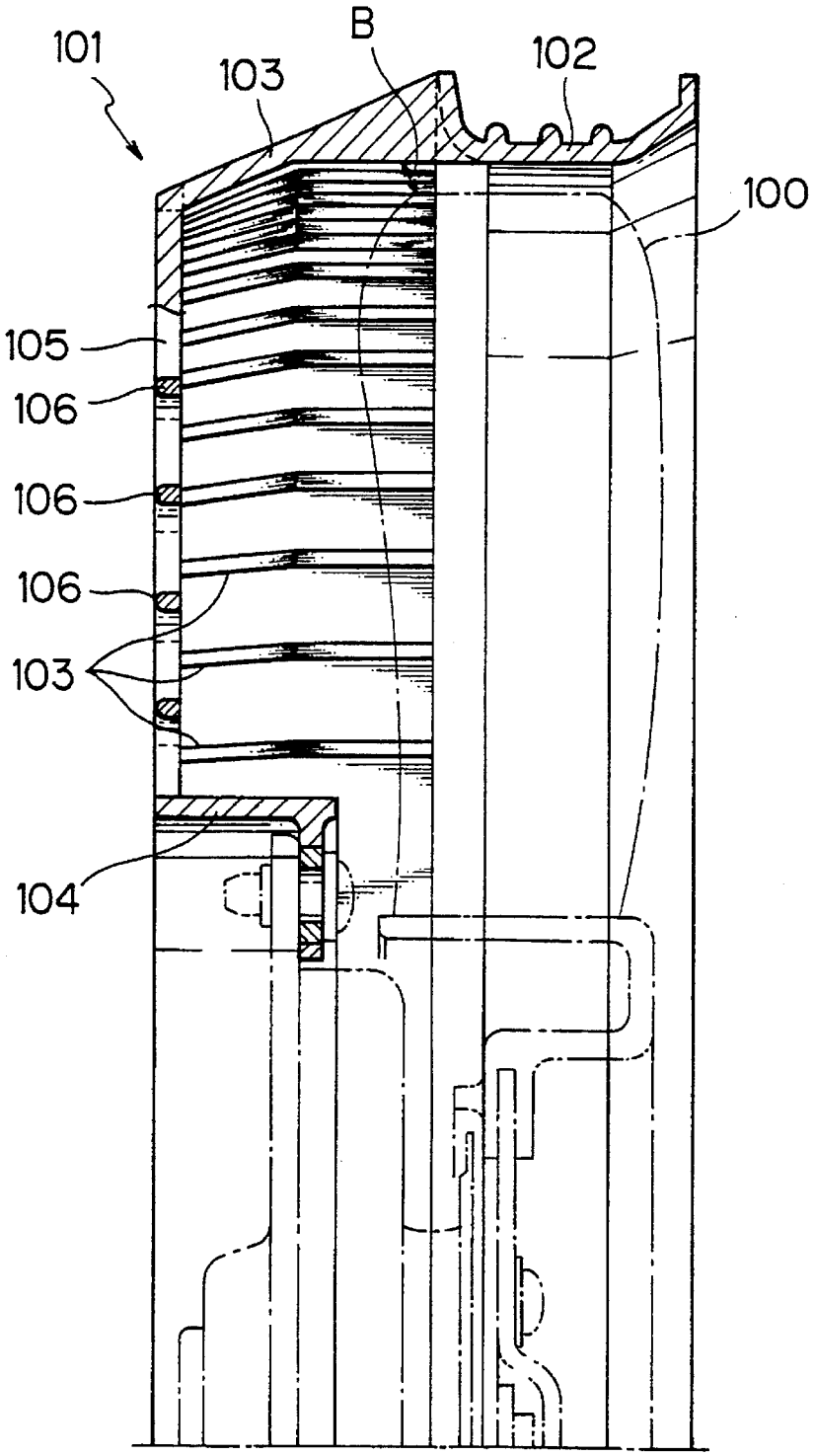
Fig. 7 ( PRIOR ART )
FIG. 7 is a cross-sectional view similar to FIG. 1, illustrating the shroud assembly of the convention blower; and, FIG. 8 is a front view of the conventional blower.
Figure 8:
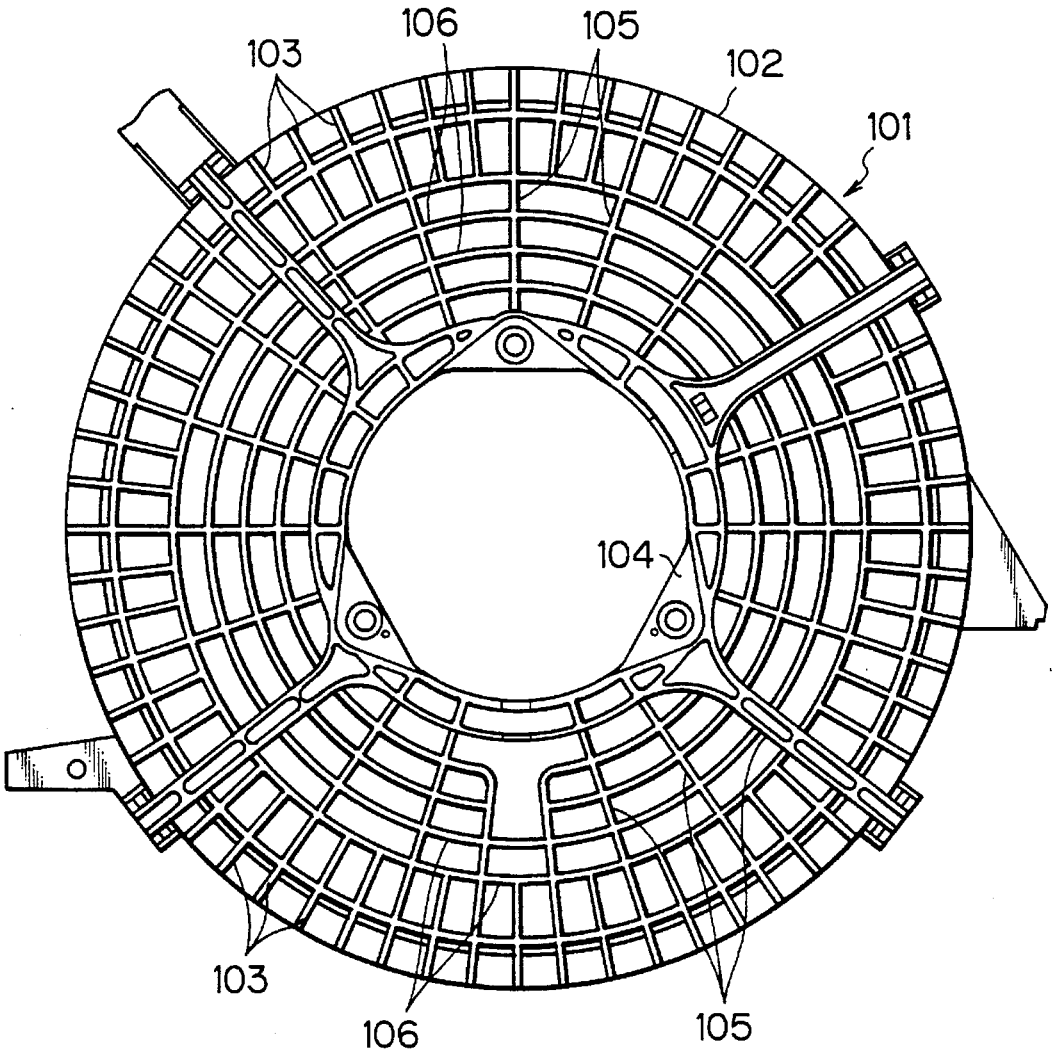
Fig. 8 ( PRIOR ART )

When the electric motor 3 is operated so as to drive the axial fan 2, the blades 1 of the axial fan 2 are rotated about the axis of the fan 2, and accordingly, air is drawn from the exterior of the blower into the fan shroud 5 through the spacings provided by the ring-like portions 13 and through the spacings provided by the support ribs 17. The drawn air, i.e., the intake air is blown by the rotating blades 1 of the axial fan 2 from the fan shroud 5 of the shroud assembly 4 to a destination, i.e., the refrigerant condenser or the automobile radiator to: an automobile. A part of the air drawn by the axial fan 2 into the fan shroud 5 is sucked through the spacings between respective two neighboring support ribs 17 from the external region therearound. At this stage, each of the support ribs 17 is arranged at a radially outer portion of the bell-mouth portion 10, and therefore, a distance "A" (FIG. 1) between the support rib 17 and the axial fan 2 can be larger than the distance "B" of the conventional blower (see FIG. 7). Accordingly, the turbulence of the air which occurs downstream the support ribs 17 is attenuated before the air reaches the axial fan 2, and accordingly, a whistling or hissing sound of the air passing across the support ribs 17 and through the axial fan 2 can be sufficiently lowered.

Further, since the support ribs 17 of the shroud assembly 4 of the blower according to the present invention have the form of a cylindrical projection, the turbulence of air occurring downstream the support ribs 17 can be small compared with the turbulence that occurs with the support ribs 103 (FIG. 7) of the conventional blower. This fact also contributes to effectively lowering the level of the hissing or whistling sound.

From the foregoing description of the embodiment of the present invention, it will be understood that the support ribs of the shroud assembly of the blower of the present invention are arranged as axially extending projections in parallel with the axis of the axial fan of the blower. Therefore, when the shroud assembly is manufactured by a molding method using at least two molding dies, it is possible to obtain the support ribs by using the molding die by which the bell-mouth portion of the fan shroud is molded. Accordingly, it is possible to locate the support ribs at the outside of the bell-mouth portion of the fan shroud. Therefore, the support ribs can be spaced apart from the end of the axial fan of the blower. Consequently, the turbulence of air occurring downstream from the support ribs can be sufficiently attenuated resulting in a lowering of the level of the hissing or whistling sound of the air passing across the support ribs and through the axial fan.

Further, since the axially extending support ribs of the shroud assembly of the blower according to the present invention are molded as linear projections by the same molding die as that used for molding the bell-mouth portion of the fan shroud, the cross section of the support ribs of the shroud assembly can be one of various sections such as a circular section, an ellipsoidal section and a streamline section. As a result, when, for example, the support ribs have the circular section, respectively, it is possible to reduce occurrence of turbulence of air downstream the support ribs to thereby lower the hissing or whistling sound of the air when it passes across the support ribs and across the axial fan. Thus, the blower of the present invention can be a noise-free blower when it is accommodated in an automobile.

Moreover, in accordance with the present invention, the parting of the molding dies for molding the shroud assembly having rod-like support ribs can be achieved by simply moving the respective molding dies in the linear directions with respect to the axis of the axial fan of the blower at the final stage of the molding process. Therefore, the molding process can be simplified, and the maintenance of the molding dies can also be simplified. As a result, it is possible to reduce the manufacturing cost of the resin-made shroud assembly of the blower.

It should be understood that many modifications and variations to the blower of the present invention will occur to a person skilled in the art without departing from the spirit and scope of the invention as claimed in the accompanying claims. For example, as required, the shroud assembly of the blower may be made of metallic material instead of the described resin material by using the die-casting method. The axial fan of the blower may be driven by a hydraulic motor or by an engine via an appropriate rotation transmitting device.

We claim:

1. A blower for generating an air flow discharged toward a destination comprising:

an axial fan arranged so as to be driven by a rotating drive source, and provided with a plurality of rotating blades generating said flow of air during rotation thereof about an axis of the axial fan;

a fan shroud in the form of a substantially cylindrical hollow member enclosing the outer circumference of the axial fan and having an end facing an air intake side of the blower and an opposite end facing an air discharge side of the blower, the fan shroud being provided with a bell-mouth portion thereof flaring toward the air intake side;

a plurality of pin-like support ribs formed so as to be integral with the fan shroud, and arranged so as to project from an outermost end of the bell-mouth portion of the fan shroud toward the air intake side, the plurality of support ribs being disposed along an entire outer circumference of the bell-mouth portion of the fan shroud in a juxtaposed arrangement, and so as to be parallel with the axis of the axial fan;

a support bracket arranged for supporting the rotating drive source of the axial fan at the air intake side of the blower, the support bracket being formed so as to be integral with the fan shroud;

a plurality of stays formed so as to be integral with the fan shroud and the support bracket, the plurality of stays being arranged at the air intake side of the blower, and providing a physical connection between the fan shroud and the support bracket, the plurality of stays including support beams extending substantially in parallel with the axis of the axial fan; and a plurality of ring-like members formed so as to be integral with the fan shroud, the support bracket, and the plurality of stays, the plurality of ring-like members being arranged at the air intake side of the blower, and providing the plurality of stays with a physical connection thereamong.

2. A blower according to claim 1, wherein said fan shroud, said plurality of supporting ribs, said support bracket, said plurality of stays, and said plurality of ring-like members are all made of moldable material, and are integrally molded by a molding die assembly including at least two first and second molding dies parting toward the air discharge side and the air intake side, respectively.

3. A blower according to claim 1, wherein said fan shroud is provided with an inner wall portion molded by a first molding die, said support bracket is provided with a portion facing the air discharge side and molded by said first molding die, said plurality of stays are provided with portions facing the air discharge side and molded by said first molding die, and said ring-like members are provided with portions facing the air discharge side and molded by said first molding die, wherein said support bracket is provided with a further portion facing the air intake side and molded by a second molding die, said plurality of stays are further provided with further portions facing said air discharge side and molded by said second molding die, and said ring-like members are further provided with further portions facing said air intake side and molded by said second molding die, and;

wherein said support ribs are molded by said second molding die.

4. A blower according to claim 2, wherein said moldable material from which said fan shroud, said plurality of supporting ribs, said support bracket, said plurality of stays, and said plurality of ring-like members are molded is a resin material.

5. A blower according to claim 4, wherein said resin material is a polypropylene resin.

6. A blower according to claim 1, wherein each of said pin-like support ribs is a linearly extending cylinder member having a circular section and a spherical outermost end thereof.

7. A blower according to claim 6, wherein said support ribs project from a flaring end of said bell-mouth portion of said fan shroud, so that said support ribs are arranged at a radially distant position with respect to said axis of said axial fan, whereby said support ribs define a substantially wide spacing between said ribs support and said axial fan.

8. A blower according to claim 1, wherein said rotating drive source supported by said support bracket is a removably fixed electric motor.

9. A blower adapted for generating an air flow to be discharged toward a heat exchanging device incorporated in an automobile having a rotating drive source, an axial fan driven by said rotating drive source, said axial fan being provided with a plurality of rotating blades generating said flow of air during rotation thereof about an axis of said axial fan, and a shroud assembly comprising:

a fan shroud in the form of a substantially cylindrical hollow member enclosing an outer circumference of said axial fan and having an end facing an air intake side of said blower and an opposite end facing an air discharge side of said blower, said fan shroud being provided with a bell-mouth portion thereof flaring toward said air intake side;

a plurality of pin-like support ribs formed so as to be integral with said fan shroud, and arranged so as to project from an outermost end of said bell-mouth portion of said fan shroud toward said air intake side, said plurality of support ribs being disposed along an entire outer circumference of said bell-mouth portion of said fan shroud in a juxtaposed arrangement, and so as to be parallel with said axis of said axial fan;

a support bracket arranged for supporting said rotating drive source of said axial fan at said air intake side of said blower, said support bracket being formed so as to be integral with said fan shroud;

a plurality of stays formed so as to be integral with said fan shroud and said support bracket, said plurality of stays being arranged at said air intake side of said blower, and providing a physical connection between said fan shroud and said support bracket, said plurality of stays including support beams extending substantially in parallel with said axis of said axial fan; and a plurality of ring-like members formed so as to be integral with said fan shroud, said support bracket, and said plurality of stays, said plurality of ring-like members being arranged at said air intake side of said blower, and providing said plurality of stays with a physical connection thereamong.

10. A blower according to claim 9, wherein said shroud assembly comprises a resin-made molded assembly in which said fan shroud, said plurality of pin-like support ribs, said support bracket, said plurality of stays, and said plurality of ring-like members are integrally molded.

11. A blower according to claim 9, wherein each of said pin-like support ribs comprises a cylindrical projection linearly extending from an outermost end of said bell-mouth portion of said fan shroud in a direction parallel with said axis of said axial fan, and having a circular section thereof and a spherical extreme end thereof.

12. A blower according to claim 9, wherein said rotating drive source comprises an electric drive motor.

* * * * *